US007971718B2

(12) United States Patent
Aldridge

(10) Patent No.: US 7,971,718 B2
(45) **Date of Patent: *Jul. 5, 2011**

(54) PACKAGE FOR DISPENSING AND RETAINING GUM SLABS WITH ADHESIVE SECUREMENT

(75) Inventor: Allen Sydney Aldridge, South Orange, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/005,761

(22) Filed: Dec. 28, 2007

(65) Prior Publication Data

US 2008/0142392 A1 Jun. 19, 2008

Related U.S. Application Data

(63) Continuation of application No. 11/124,922, filed on May 9, 2005, now Pat. No. 7,325,686.

(60) Provisional application No. 60/570,004, filed on May 11, 2004, provisional application No. 60/570,015, filed on May 11, 2004.

(51) Int. Cl.
*B65D 85/60* (2006.01)

(52) U.S. Cl. ..... 206/460; 206/37; 206/449; 206/800; 206/813; 229/87.07; 426/115

(58) Field of Classification Search ..... 206/37–39, 206/256, 264, 271, 449, 460, 443, 472, 474, 206/526, 784, 800, 813; 229/87.05, 87.07, 229/120.01, 120.011, 120.09; 426/5, 115, 426/119, 6, 108

See application file for complete search history.

(56) References Cited

U.S. PATENT DOCUMENTS

| | | | |
|---|---|---|---|
| 183,466 | A | 10/1876 | Pearl |
| 271,580 | A | 1/1883 | Jones |
| 276,171 | A | 4/1883 | Fraser |
| 329,134 | A | 10/1885 | Brotz |
| 528,186 | A | 10/1894 | Strakosch |
| 603,872 | A | 5/1898 | Bucklin |
| 624,583 | A | 5/1899 | Vierengel |
| 656,349 | A | 8/1900 | Hilson |
| 732,844 | A | 7/1903 | Gerbereux |
| 924,275 | A | 6/1909 | Richardson |
| 1,037,218 | A | 9/1912 | Dirnberger |
| 1,096,909 | A | 5/1914 | Harvey |
| 1,132,781 | A | 3/1915 | Lile |

(Continued)

FOREIGN PATENT DOCUMENTS

| | | |
|---|---|---|
| BE | 417615 | 9/1936 |

(Continued)

OTHER PUBLICATIONS

Mr. Brown Chewing Gum, Product Description, p. 1, http://www.gnpd.com, Feb. 7, 2000.

Third Party Observations, European Patent Office, Application No. 05768974.7, 11 pages, Dec. 15, 2009.

(Continued)

*Primary Examiner* — Luan K Bui

(74) *Attorney, Agent, or Firm* — Hoffmann & Baron, LLP

(57) ABSTRACT

A package assembly includes individual elongate consumable products. The package assembly includes a plurality of products arranged in a side-by-side array. The package housing supports the array of products. The package housing includes a back wall and a foldable front wall. The front wall includes an adhesive location therealong for releaseably adhesively retaining the array of products in the package housing.

14 Claims, 3 Drawing Sheets

U.S. PATENT DOCUMENTS

| | | | | |
|---|---|---|---|---|
| 1,144,559 | A | | 6/1915 | Mendelson et al. |
| 1,193,423 | A | | 8/1916 | Pryor |
| 1,216,259 | A | | 2/1917 | Armstrong |
| 1,253,219 | A | | 1/1918 | Dula |
| 1,275,904 | A | | 8/1918 | Grotta |
| 1,320,287 | A | | 10/1919 | Stern |
| 1,382,459 | A | | 6/1921 | Bercovici |
| 1,432,932 | A | | 10/1922 | Weis |
| 1,433,439 | A | | 10/1922 | Weis |
| 1,469,080 | A | | 9/1923 | Goerk |
| 1,490,529 | A | | 4/1924 | Dittgen |
| 1,550,966 | A | | 8/1925 | Kappes |
| 1,575,420 | A | | 3/1926 | Eisenstark et al. |
| 1,625,651 | A | | 4/1927 | Gretsch |
| 1,683,651 | A | | 9/1928 | Bovard |
| 1,684,381 | A | | 9/1928 | Bahr |
| 1,735,325 | A | | 11/1928 | L'enfant |
| 1,751,208 | A | | 3/1930 | Kappes |
| 1,755,579 | A | | 4/1930 | Grupe |
| 1,763,763 | A | | 7/1930 | Denmead |
| 1,805,417 | A | | 5/1931 | Ritzel |
| 1,805,418 | A | | 5/1931 | Ritzel |
| 1,806,905 | A | | 5/1931 | Kampfman |
| 1,824,491 | A | | 9/1931 | Molins |
| 1,854,849 | A | | 4/1932 | Lerch |
| 1,863,190 | A | | 6/1932 | Coulapides |
| 1,864,493 | A | | 6/1932 | Bombard et al. |
| 1,865,535 | A | | 7/1932 | Meany |
| 1,870,299 | A | | 8/1932 | Strelitz |
| 1,871,426 | A | | 8/1932 | Schmitt |
| 1,875,197 | A | | 8/1932 | Molins |
| 1,895,233 | A | | 1/1933 | Rossen |
| 1,906,742 | A | | 5/1933 | Coulapides |
| 1,929,148 | A | | 10/1933 | Molins et al. |
| 2,008,168 | A | | 7/1935 | Bergstein |
| 2,008,361 | A | | 7/1935 | Lindsey |
| 2,031,011 | A | | 2/1936 | Solon |
| 2,032,661 | A | | 3/1936 | Linker |
| 2,039,491 | A | | 5/1936 | Nolan |
| 2,042,073 | A | | 5/1936 | Rose |
| 2,049,124 | A | | 7/1936 | Linderman |
| 2,074,451 | A | * | 3/1937 | Berberian ..... 206/256 |
| 2,085,728 | A | | 7/1937 | Clark |
| 2,117,281 | A | | 5/1938 | Bravi |
| 2,118,849 | A | | 5/1938 | Lindsey |
| 2,128,843 | A | | 8/1938 | Mullins |
| 2,140,748 | A | | 12/1938 | Johanson |
| 2,158,971 | A | | 5/1939 | Stratton |
| 2,165,539 | A | | 7/1939 | Dahlgren |
| 2,192,472 | A | * | 3/1940 | Huston ..... 426/5 |
| 2,192,473 | A | | 3/1940 | Huston |
| 2,197,219 | A | | 4/1940 | Gorshong |
| 2,201,956 | A | | 5/1940 | Little |
| 2,208,229 | A | | 7/1940 | Ranney |
| 2,210,194 | A | | 8/1940 | Baldwin |
| 2,210,195 | A | | 8/1940 | Baldwin |
| 2,210,196 | A | | 8/1940 | Baldwin |
| 2,212,773 | A | | 8/1940 | Gray |
| 2,251,102 | A | | 7/1941 | Atterberg |
| 2,263,191 | A | | 11/1941 | Saladin et al. |
| 2,268,379 | A | | 12/1941 | Bird et al. |
| 2,276,577 | A | | 3/1942 | Hahn |
| 2,277,097 | A | | 3/1942 | Hansen |
| 2,298,028 | A | | 7/1942 | Manko |
| 2,327,301 | A | | 8/1943 | David |
| 2,343,222 | A | | 2/1944 | Nelson |
| 2,379,934 | A | | 7/1945 | Seiferth |
| 2,380,367 | A | | 7/1945 | Ranny |
| 2,470,388 | A | | 5/1949 | Ball |
| 2,547,779 | A | | 4/1951 | Renyck |
| 2,563,689 | A | | 8/1951 | Muhlhauser |
| 2,578,583 | A | | 12/1951 | O'Brien |
| 2,605,897 | A | | 8/1952 | Rundle |
| 2,619,092 | A | | 11/1952 | Ayers |
| 2,619,226 | A | | 11/1952 | Adams |
| 2,682,475 | A | | 6/1954 | Smith |
| 2,719,663 | A | | 10/1955 | Meyer-Jagenberg |
| 2,744,624 | A | | 5/1956 | Hoogstoel et al. |
| 2,755,918 | A | | 7/1956 | Gargagliano |
| 2,799,441 | A | | 7/1957 | Nerney |
| 2,801,002 | A | | 7/1957 | Volckening et al. |
| 2,803,376 | A | | 8/1957 | Kampff |
| 2,812,057 | A | | 11/1957 | Brownfield |
| 2,820,545 | A | | 1/1958 | Bramhill |
| 2,823,798 | A | | 2/1958 | Volckening et al. |
| 2,858,060 | A | | 10/1958 | Kuchler |
| 2,871,080 | A | | 1/1959 | Shelly |
| 2,883,045 | A | | 4/1959 | Abramson |
| 2,923,110 | A | | 2/1960 | Tamari |
| 2,933,182 | A | | 4/1960 | Davis |
| 2,954,116 | A | | 9/1960 | Maso et al. |
| 2,962,161 | A | | 11/1960 | Lacy |
| 2,988,209 | A | | 6/1961 | Parrilla |
| 3,002,674 | A | | 10/1961 | Wright |
| 3,027,998 | A | | 4/1962 | Ridgway |
| 3,035,756 | A | | 5/1962 | Mullinix |
| 3,047,144 | A | | 7/1962 | Wissel |
| 3,071,244 | A | | 1/1963 | Doran |
| 3,092,501 | A | | 6/1963 | Beck et al. |
| 3,108,711 | A | | 10/1963 | Anton |
| 3,113,673 | A | | 12/1963 | Stein |
| 3,118,588 | A | | 1/1964 | Noble |
| 3,152,694 | A | | 10/1964 | Nashed et al. |
| 3,165,249 | A | | 1/1965 | Peck |
| 3,187,889 | A | | 6/1965 | Sinclair |
| 3,201,258 | A | | 8/1965 | Mastella |
| 3,201,536 | A | | 8/1965 | Fisher et al. |
| 3,204,759 | A | | 9/1965 | Palmer |
| 3,206,094 | A | | 9/1965 | Humphrey et al. |
| 3,224,922 | A | | 12/1965 | Fry, Jr. |
| 3,225,922 | A | | 12/1965 | Straight |
| 3,272,423 | A | | 9/1966 | Bjarno |
| 3,282,413 | A | | 11/1966 | Sparks |
| 3,322,323 | A | | 5/1967 | Greene et al. |
| 3,323,643 | A | | 6/1967 | Rush |
| 3,367,552 | A | | 2/1968 | Krzyanowski |
| 3,374,884 | A | | 3/1968 | Chinkes |
| 3,389,784 | A | | 6/1968 | Hendricks et al. |
| 3,389,852 | A | | 6/1968 | Egli |
| 3,438,565 | A | | 4/1969 | Lugt et al. |
| 3,509,989 | A | | 5/1970 | Woll |
| 3,524,583 | A | | 8/1970 | Gregory |
| 3,542,191 | A | | 11/1970 | Scott |
| 3,580,466 | A | | 5/1971 | Thelen |
| 3,583,358 | A | | 6/1971 | Hanson, Jr. |
| 3,591,071 | A | | 7/1971 | Rosenburg, Jr. |
| 3,623,653 | A | | 11/1971 | Work |
| 3,642,564 | A | | 2/1972 | Walker et al. |
| 3,664,572 | A | | 5/1972 | Puchkoff et al. |
| 3,708,946 | A | | 1/1973 | Cahill |
| 3,732,663 | A | | 5/1973 | Geldmacher |
| 3,734,280 | A | | 5/1973 | Amneus et al. |
| 3,734,801 | A | | 5/1973 | Sebel |
| 3,756,385 | A | | 9/1973 | Steinbock |
| 3,835,989 | A | | 9/1974 | Mori et al. |
| 3,881,649 | A | | 5/1975 | Krautsack |
| 3,923,239 | A | | 12/1975 | Lee |
| 3,924,739 | A | | 12/1975 | Gravesteijn |
| 3,938,655 | A | | 2/1976 | Romolt |
| 3,966,045 | A | | 6/1976 | Perdue |
| 3,991,168 | A | | 11/1976 | Richards et al. |
| 4,015,770 | A | | 4/1977 | Tamarin |
| 4,053,049 | A | | 10/1977 | Beauvais |
| 4,101,024 | A | | 7/1978 | Furuya et al. |
| 4,119,196 | A | | 10/1978 | Flaherty |
| 4,125,189 | A | | 11/1978 | Fujimoto et al. |
| 4,131,195 | A | | 12/1978 | Worrell, Sr. |
| D250,748 | S | | 1/1979 | Leger |
| 4,142,635 | A | | 3/1979 | Capo et al. |
| 4,192,420 | A | | 3/1980 | Worrell, Sr. et al. |
| 4,197,949 | A | | 4/1980 | Carlsson |
| 4,216,898 | A | | 8/1980 | Davies |
| 4,234,084 | A | | 11/1980 | Hutten |
| 4,260,061 | A | | 4/1981 | Jacobs |
| RE30,616 | E | | 5/1981 | Hofer |
| 4,294,353 | A | | 10/1981 | Focke et al. |
| 4,360,106 | A | | 11/1982 | Irvine et al. |

| | | | |
|---|---|---|---|
| 4,377,235 | A | 3/1983 | Carver |
| 4,411,365 | A | 10/1983 | Horikawa et al. |
| 4,436,205 | A | 3/1984 | Horii |
| 4,441,611 | A | 4/1984 | Sommariva |
| 4,464,154 | A | 8/1984 | Ljungcrantz |
| 4,470,508 | A | 9/1984 | Yen |
| 4,546,875 | A | 10/1985 | Zweber |
| 4,552,269 | A | 11/1985 | Chang |
| 4,610,357 | A | 9/1986 | Nakamura |
| 4,637,544 | A | 1/1987 | Quercetti |
| 4,658,963 | A | 4/1987 | Jud |
| 4,666,040 | A | 5/1987 | Murata |
| 4,679,693 | A | 7/1987 | Forman |
| 4,738,359 | A | 4/1988 | Phillips, Jr. |
| 4,850,482 | A | 7/1989 | Campbell |
| 4,874,096 | A | 10/1989 | Tessera-Chiesa |
| 4,902,142 | A | 2/1990 | Lammert et al. |
| 4,912,910 | A | 4/1990 | Lowe et al. |
| 4,949,841 | A | 8/1990 | Focke et al. |
| 4,961,496 | A | 10/1990 | Focke et al. |
| 4,997,082 | A | 3/1991 | Durocher |
| 5,029,712 | A | 7/1991 | O'Brien et al. |
| 5,078,509 | A | 1/1992 | Center et al. |
| 5,080,227 | A | 1/1992 | Focke |
| 5,092,465 | A | 3/1992 | Weder et al. |
| 5,096,113 | A | 3/1992 | Focke |
| 5,123,589 | A | 6/1992 | Cote |
| 5,125,211 | A | 6/1992 | O'Brien |
| 5,128,157 | A | 7/1992 | Ruiz |
| 5,145,091 | A | 9/1992 | Meyers |
| 5,150,720 | A | 9/1992 | Focke et al. |
| 5,192,386 | A | 3/1993 | Moir et al. |
| 5,195,637 | A | 3/1993 | Weder |
| 5,215,249 | A | 6/1993 | Gorrieri |
| 5,240,109 | A | 8/1993 | Weder et al. |
| 5,255,784 | A | 10/1993 | Weder et al. |
| 5,290,616 | A | 3/1994 | Cowan et al. |
| 5,301,804 | A | 4/1994 | Focke et al. |
| 5,307,988 | A | 5/1994 | Focke et al. |
| 5,311,992 | A | 5/1994 | Weder et al. |
| 5,316,211 | A | 5/1994 | Chang |
| 5,344,008 | A | 9/1994 | DeBlasio et al. |
| D351,104 | S | 10/1994 | Kapp |
| 5,358,171 | A | 10/1994 | Focke |
| 5,407,072 | A | 4/1995 | Weder et al. |
| 5,427,235 | A | 6/1995 | Powell et al. |
| 5,435,439 | A | 7/1995 | Swart |
| 5,462,223 | A | 10/1995 | Focke et al. |
| D365,023 | S | 12/1995 | Abrams et al. |
| 5,489,060 | A | 2/1996 | Godard |
| 5,510,124 | A | 4/1996 | Kopecky et al. |
| 5,511,658 | A | 4/1996 | Focke et al. |
| 5,515,965 | A | 5/1996 | Boldrini et al. |
| 5,522,205 | A | 6/1996 | Weder |
| 5,553,773 | A | 9/1996 | Focke et al. |
| 5,556,026 | A | 9/1996 | Blankitny |
| 5,560,482 | A | 10/1996 | Katagiri et al. |
| 5,575,385 | A | 11/1996 | Zona |
| 5,607,056 | A | 3/1997 | Whiteside |
| 5,620,550 | A | 4/1997 | Andersson et al. |
| 5,632,378 | A | 5/1997 | Provost |
| 5,636,732 | A | 6/1997 | Gilels et al. |
| 5,732,823 | A | 3/1998 | Weder et al. |
| 5,738,207 | A | 4/1998 | Trimani |
| 5,783,266 | A | 7/1998 | Gehrke |
| 5,797,494 | A | 8/1998 | Balling et al. |
| 5,819,925 | A | 10/1998 | Brizzi et al. |
| 5,823,331 | A | 10/1998 | Manservigi et al. |
| 5,836,448 | A | 11/1998 | Weder |
| 5,855,434 | A | 1/1999 | Hagen |
| 5,860,524 | A | 1/1999 | Weder |
| 5,860,526 | A | 1/1999 | Burke, Jr. |
| 5,878,883 | A | 3/1999 | Weder |
| 5,924,571 | A | 7/1999 | Cornelissen |
| 5,941,641 | A | 8/1999 | Kinigakis et al. |
| 5,944,188 | A | 8/1999 | Grosskopf et al. |
| 5,992,621 | A | 11/1999 | Grant et al. |
| 5,996,797 | A | 12/1999 | Flaig |
| 6,001,397 | A | 12/1999 | Boyd et al. |
| 6,010,724 | A | 1/2000 | Boyd et al. |
| 6,026,953 | A | 2/2000 | Nakamura et al. |
| D421,568 | S | 3/2000 | Ferguson et al. |
| 6,044,848 | A | 4/2000 | Huang |
| 6,094,917 | A | 8/2000 | Sundhar et al. |
| 6,105,856 | A | 8/2000 | Kakiuchi |
| 6,164,444 | A | 12/2000 | Bray et al. |
| 6,199,687 | B1 | 3/2001 | Tambo et al. |
| 6,202,838 | B1 | 3/2001 | Tran |
| 6,220,430 | B1 | 4/2001 | Boriani et al. |
| 6,228,450 | B1 | 5/2001 | Pedrini |
| 6,237,760 | B1 | 5/2001 | Parker et al. |
| 6,309,105 | B1 | 10/2001 | Palumbo |
| 6,334,532 | B1 | 1/2002 | Tambo et al. |
| 6,395,317 | B1 | 5/2002 | Singh et al. |
| D465,416 | S | 11/2002 | Dzwill et al. |
| 6,478,149 | B1 | 11/2002 | Parker |
| 6,505,735 | B1 | 1/2003 | Parker |
| D471,804 | S | 3/2003 | Staples |
| D479,464 | S | 9/2003 | Kopecky |
| D479,646 | S | 9/2003 | Overton |
| 6,644,488 | B1 | 11/2003 | Coleman |
| D484,046 | S | 12/2003 | Kopecky |
| 6,709,684 | B2 | 3/2004 | Loth |
| 7,032,754 | B2 | 4/2006 | Kopecky |
| 7,159,717 | B2 | 1/2007 | Aldridge et al. |
| 7,467,711 | B2 | 12/2008 | Tambo |
| 7,527,189 | B2 | 5/2009 | Billig et al. |
| 2002/0063079 | A1 | 5/2002 | Loth |
| 2003/0034255 | A1 | 2/2003 | Luton et al. |
| 2003/0047470 | A1 | 3/2003 | Parker |
| 2003/0080020 | A1 | 5/2003 | Kopecky |
| 2003/0106928 | A1 | 6/2003 | Li Vigni et al. |
| 2005/0218198 | A1 | 10/2005 | Cavero et al. |
| 2005/0276525 | A1 | 12/2005 | Hebert et al. |
| 2006/0027483 | A1 | 2/2006 | Aldridge |
| 2007/0134371 | A1 | 6/2007 | Billig et al. |
| 2007/0138035 | A1 | 6/2007 | Fluegel et al. |
| 2007/0141199 | A1 | 6/2007 | Ishikawa et al. |

FOREIGN PATENT DOCUMENTS

| | | | |
|---|---|---|---|
| BE | 417615 | | 10/1936 |
| CN | 1331646 | | 1/2002 |
| DE | 653242 | | 11/1937 |
| DE | 9405638 | | 6/1994 |
| DE | 10238905 | | 3/2004 |
| EP | 0 801 000 | | 10/1997 |
| EP | 1367005 | | 12/2003 |
| EP | 1591027 | | 11/2005 |
| EP | 1595807 | | 11/2005 |
| FR | 762011 | | 9/1933 |
| FR | 762011 | | 4/1934 |
| FR | 1204079 | | 10/1958 |
| FR | 1204079 | | 1/1960 |
| GB | 461794 | | 2/1937 |
| GB | 808056 | | 1/1959 |
| GB | 2 074 532 | | 11/1981 |
| GB | 2078202 | | 1/1982 |
| GB | 2227221 | | 7/1990 |
| JP | 2-138584 | * | 11/1990 |
| JP | 07-099891 | | 4/1995 |
| JP | 3022304 | | 12/1995 |
| JP | 09-110072 | | 4/1997 |
| JP | 9-110072 | | 4/1997 |
| JP | 11-1221 | * | 1/1999 |
| JP | 11-001220 | | 6/1999 |
| JP | 11-301648 | | 11/1999 |
| WO | 00/12407 | | 3/2000 |
| WO | WO 01/07335 | | 2/2001 |
| WO | WO 03/037744 | | 5/2003 |
| WO | 2008051813 | | 5/2008 |

OTHER PUBLICATIONS

Notice of Opposition, European Patent Office, Application No. 05748373.7, 24 paaes, Apr. 7, 2010.

U.S. Appl. No. 60/560,306, filed Apr. 6, 2004, 47 pages.

* cited by examiner

PACKAGE FOR DISPENSING AND RETAINING GUM SLABS WITH ADHESIVE SECUREMENT

CROSS-REFERENCE TO RELATED APPLICATIONS

This application is a continuation of and claims priority to U.S. application Ser. No. 11/124,922, filed May 9, 2005, now U.S. Pat. No. 7,325,686, and U.S. Provisional Application No. 60/570,004, filed May 11, 2004; and U.S. Provisional Application No. 60/570,015, filed May 11, 2004; which are incorporated herein by reference.

FIELD OF THE INVENTION

The present invention relates generally to a package for containing an array of consumable products and retaining the products in the package until such time as it is desired to dispense the individual products. More particularly, the present invention relates to a package for retaining and dispensing gum slabs using adhesive securement.

BACKGROUND OF THE INVENTION

It is well known to house consumable products such as gum slabs in a package or housing which retains the gum slabs and allows for dispensing of an individual slab therefrom. The gum slabs are typically arranged in an array, so that a single gum slab may be removed from the array leaving the remaining gum slabs in the package. Often, the gum slabs may be wrapped individually in an outer wrapper.

Certain of the gum slab packages are of the type which maintain their outer configuration even after removal of one of the gum slabs. This creates a space in the package which allows adjacent gum slabs to become displaced. Therefore, it may become difficult to remove additional gum slabs from the package if one or more of the remaining gum slabs tilts or falls over within the package. Also, by creating such a space, the remaining gum slabs may slide or move in the package and may even fall out of the package.

One attempt to retain and dispense individual gum slabs from a package is shown in U.S. Patent Application Publication No. 2003/0080020 to Kopecky, the disclosure of which is incorporated by reference herein for all purposes. The Kopecky publication discloses a gum slab package housing formed from a die cut paperboard blank having a generally rectangular configuration. The housing includes a front cover which opens to expose a plurality of gum slabs. The gum slabs are contained in a side-by-side array by a sheet which wraps around the gum slabs. The sheet, including the gum slab array, is placed into the package housing such that the gum slabs are exposed once the front cover is opened. In order to retain the gum slabs in an upright condition and maintain the gum slabs within the package once one or more of the slabs are removed from the array, the gum slabs are adhesively secured to the sheet. The adhesive securement may take the form of wax areas on the inner surface of the sheet. Once the wrapped slabs are inserted into the sheet, heat is applied to the sheet to cause the wax to melt. The array of gum slabs secured to the sheet may then be placed in the package for retention and dispensing.

While the device disclosed in the Kopecky publication attempts to provide a package which both allows for the retention and dispensing of gum slabs, it has been found that the package may not adequately perform over the long term. Accordingly, it is desirable to provide an improved gum slab package which allows for the retention and dispensing of individual gum slabs and which will retain the remaining gum slabs in the package once one or more of the gum slabs are removed.

SUMMARY OF THE INVENTION

The present invention provides a package assembly for an individual elongate consumable product, preferably gum slabs. The assembly includes a plurality of products arranged in a side-by-side array. A package housing supports the array of products. The package housing includes a back wall and a foldable front wall. The front wall has an adhesive location therealong for adhesively retaining the products in the package housing.

In a preferred embodiment the adhesive location is a longitudinal strip which extends across the array.

The package assembly of the present invention may also include a band surrounding the array of products. The band holds the product array in removable frictional retention. The adhesive location may be in engagement with the band for adhesively supporting the band in the package housing.

The package housing may also include an adhesive strip along the back wall thereof. The adhesive strip along the back wall may be positioned for engagement with the products.

DETAILED DESCRIPTION OF THE PREFERRED EMBODIMENTS

The present invention is directed to a package assembly which contains a plurality of consumable products in a package housing. The package housing is openable to allow dispensing of one or more products therefrom and is reclosable to contain and maintain the products therein. While the present invention is useful with a wide of variety of consumable product, it is particularly useful with respect to elongate gum slabs which are arranged in a side-by-side array.

Consumable product packages of this type are disclosed in commonly assigned U.S. patent application Ser. No. 10/883,468 filed Jul. 1, 2004, now U.S. Patent Publication No. 2005/0269233, entitled "Confectionery Packaging Design" and Ser. No. 11/025,739 filed Dec. 22, 2004, now U.S. Pat. No. 7,159,717 entitled "Gum Package Design with Two Separate Compartments", both of which are incorporated by reference herein for all purposes.

Moreover, the present invention discloses consumable product packages of the type shown in commonly assigned U.S. patent application Ser. No. 11/124,906, filed May 9, 2005, entitled "Gum Slab Package Having Insertable Product Retention Member", and also shown in commonly assigned U.S. patent application Ser. No. 11/124,926, filed May 9, 2005, entitled "Gum Slab Package With Flap Retention", both of which are incorporated by reference herein for all purposes.

Figure 1:
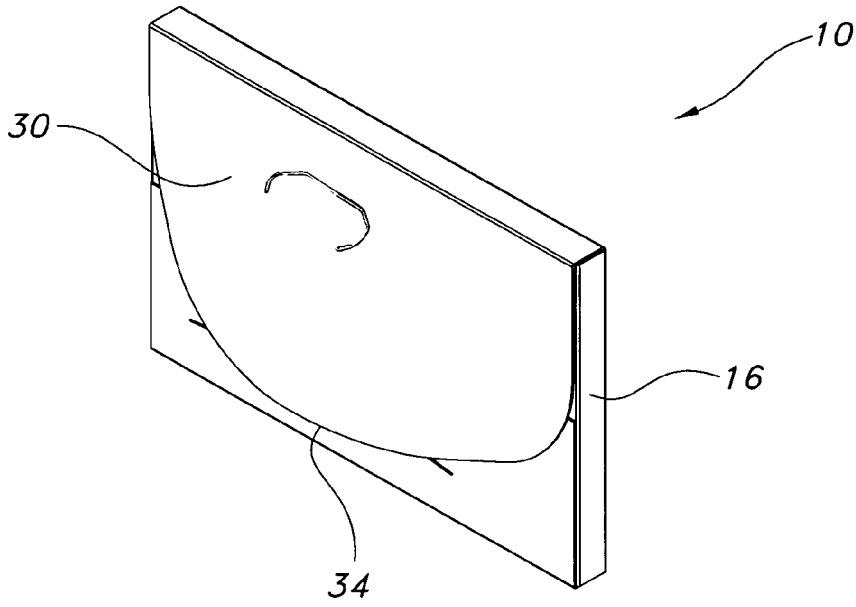
FIG. 1 is a perspective showing of the package assembly of the present invention shown in the closed condition.
Figure 2:
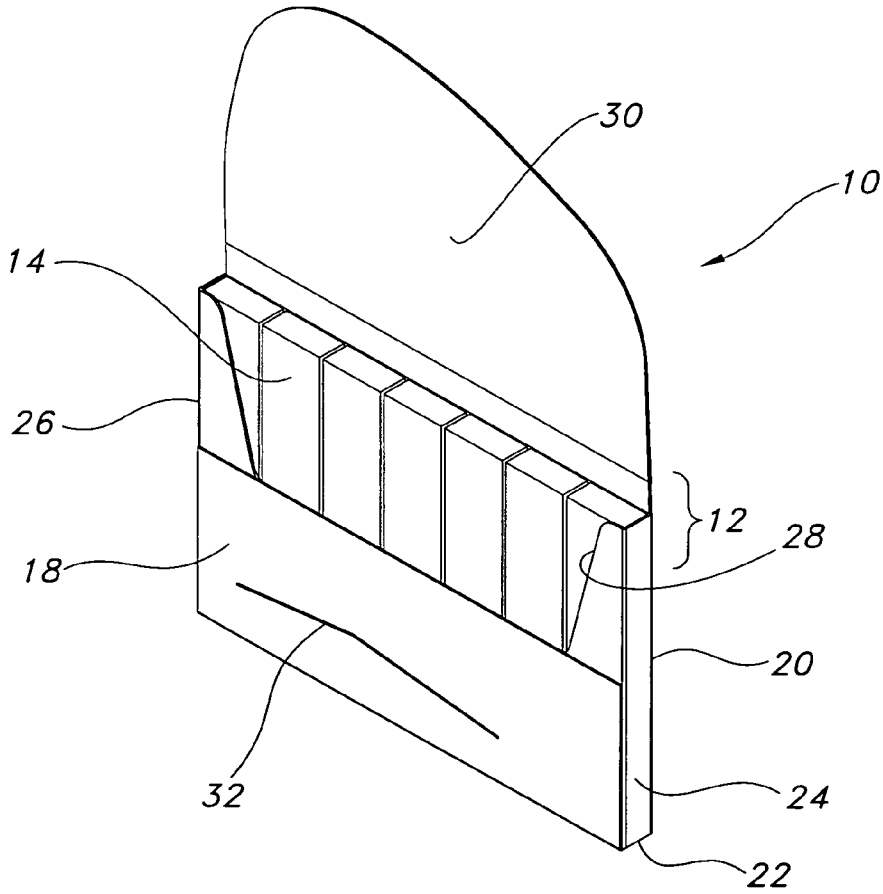
FIG. 2 is a perspective showing of the package assembly of FIG. 1 shown in the opened condition with an array of products supported therein.

Referring now to FIGS. 1 and 2, the present invention provides a packaging assembly 10 which supports therein an array 12 of gum slabs 14. Gum slabs 14 are typically elongate rectangularly shaped members which may optionally include wrappers (not shown in FIG. 2) individually around each gum slab. The gum slabs are arranged in a side-by-side fashion to form array 12. The gum slabs 14 are supported in the array in a package housing 16. The package housing 16 includes a front wall 18, an opposed back wall 20, a bottom wall 22, and opposed side walls 24 and 26. As will be described in further detail hereinbelow, the package housing is formed from die cut paperboard, which is folded in a well known manner to form the configuration shown in FIGS. 1 and 2. The package housing 16 is folded such that it provides an open upper end 28 which defines a dispensing opening. The back wall 20 includes an upwardly extending foldable cover 30 which may be folded over the open upper end to close the opening and contain the slabs 14 within the package housing 16. A slit 32 positioned in the front wall 18 allows the distal edge 34 of cover 30 to be inserted therein for reclosing purposes. Additionally, it is contemplated that the package is provided in the condition shown in FIG. 1 with the cover 30 adhesively secured to the front wall 18. Once the adhesive securement is removed to dispense the first gum slab, the flap may be reclosed by inserting it into the slit 32.

It is also contemplated that the package housing 16 may be covered by a plastic wrap (not shown) which encloses and protects the package and during shipping and prior to sale and use.

As will be described in further detail hereinbelow, it is contemplated that the array 12 of slabs 14 will be removably retentively supported within the package housing 16 so that it permits easy removal of one or more gum slabs while maintaining the remainder of the gum slabs in the package housing. Furthermore, it is contemplated that the technique for releasably supporting the slabs 14 within the package housing will permit the slabs 14 to maintain their position within the housing even after removal of one or more of the adjacent gum slabs so as to prevent the gum slabs from tilting or falling over in the package or falling out from the package.

Figure 3:
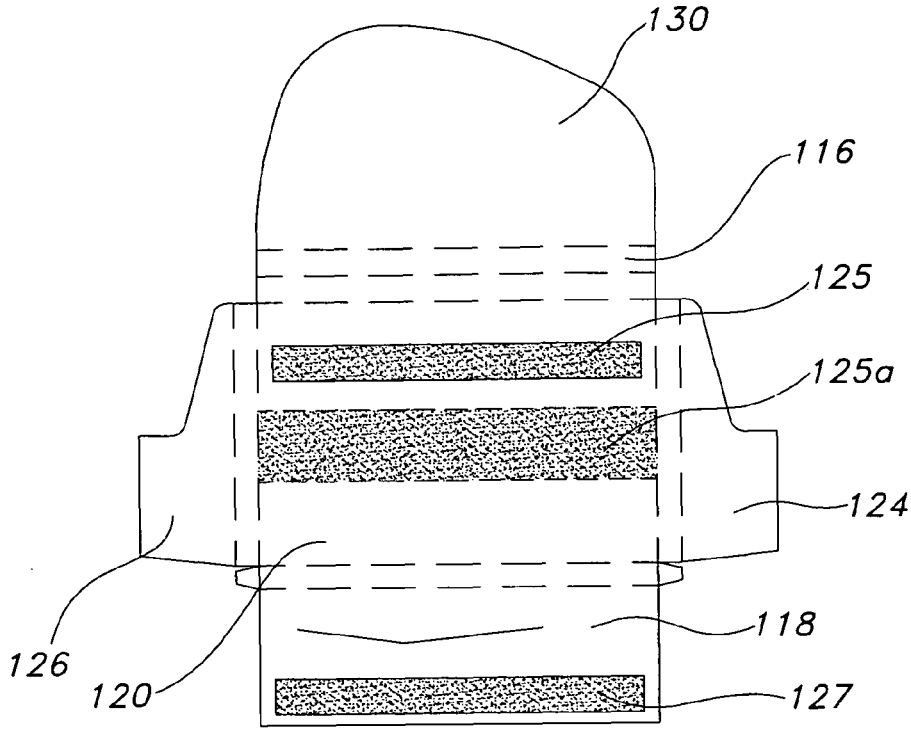
FIG. 3 shows the package housing of the package assembly of FIG. 1 in its preassembled condition.
Figure 4:
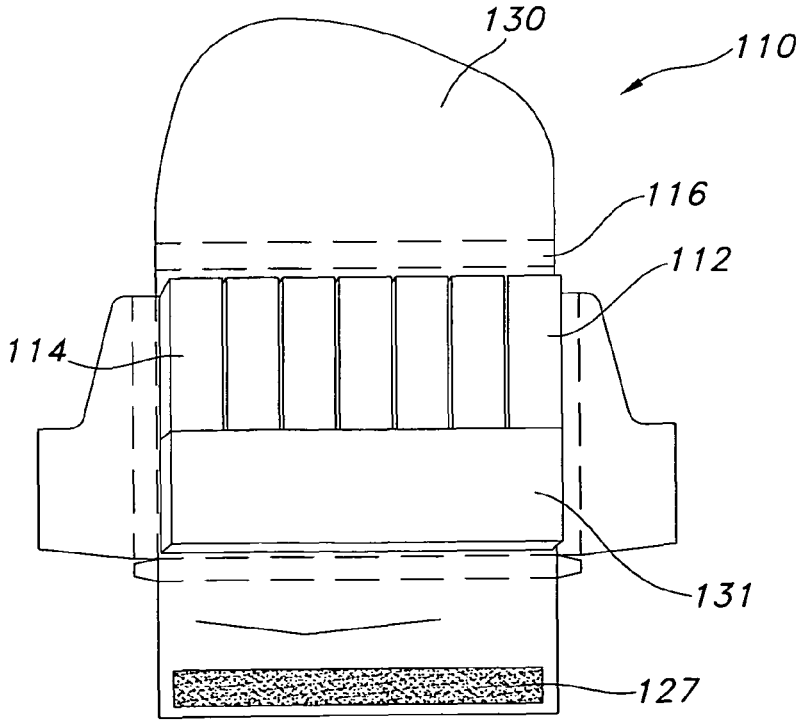
FIG. 4 shows the package housing of FIG. 3 with an array of products supported therein.

Referring now to FIGS. 3 and 4, a preferred embodiment of the present invention is shown. With respect to the present embodiment, similar reference numerals denote similar elements with 100 added to the reference numerals of FIGS. 1 and 2 to denote the present embodiment.

FIG. 3 shows package housing 116 of the package assembly 110 in its preassembled condition. Package housing 116 is formed from a die cut paperboard and is provided in a flat configuration which may be folded from the flat configuration shown in FIG. 3 into the configuration shown in FIGS. 1 and 2. The package housing 116 is shown to have the back wall 120, a foldable front wall 118, foldable side walls 124 and 126 and a foldable cover 130.

As particularly shown in FIG. 4, package assembly 110 includes an array 112 of gum slabs 114 which are supported within package housing 116. The gum slabs 114 are further contained within a band 131. Band 131 may be formed of a wide variety of materials including paper, foil or combinations thereof.

In the present illustrative, the band 131 is formed into a pouch or U-shaped configuration having opposed front and back walls, side walls and a bottom wall. The array 112 of gum slabs 114 is positioned within the band with the aligned lower ends thereof contained within the U-shaped band. While a U-shaped band is shown herein, other configurations may be employed.

Referring again to FIG. 3, back wall 120 has positioned thereacross an adhesive location in the form of a longitudinal adhesive wall strip 125. The wall strip 125 extends across the back wall 120 so as to be engagable with the array 112 of gum slabs 114 so as to provide adhesive securement thereto. The wall strip 125 is preferably positioned adjacent the upper portion of back wall 120 so as to engage the slabs 114 along an upper end thereof. It is contemplated that the adhesive provided for the adhesive location is a releasable adhesive which will retentively support the slabs 114 thereon, but which can be easily overcome so as to permit removal of the gum slabs therefrom. Wax is a well known releasable adhesive.

Furthermore, a front foldable cover 118 may also include an adhesive location defined by an adhesive flap strip 127. The flap strip is positioned so that when the front wall 118 folded in a manner shown in FIG. 2, the flap strip 127 is engagable with the gum slabs 114 in the U-shaped band 131. Again, the flap strip 127 extends transversely across the cover so as to be engagable mutually across the array 112 of gum slabs 114. It is contemplated that the positioning and width of the flap strip 127 may be selected so that the strip can engage the individual gum slabs 114 extending from the band 131 alone without engaging the band 131, or can be positioned so that it engages the band 131 alone without engaging the gum slabs or, in the further alternative, can be of sufficient width that it mutually engages both the band 131 and the gum slabs 114 simultaneously.

In addition, as shown in dotted lines in FIG. 1, the adhesive wall strip 125*a* may be positioned and be of sufficient width to engage both the gum slabs 114 and the band 131 simultaneously.

The use of the adhesive strips 125 and 127 independently result in holding of the array 112 of gum slabs 114 within package housing 116 and permit individual removal therefrom.

While the adhesive is a releasable adhesive permitting easy removal of the gum slabs therefrom, the adhesive retention is such that even where adjacent gum slabs are removed, the remaining gum slabs will not tilt or tend to fall out of the package.

Figure 5:
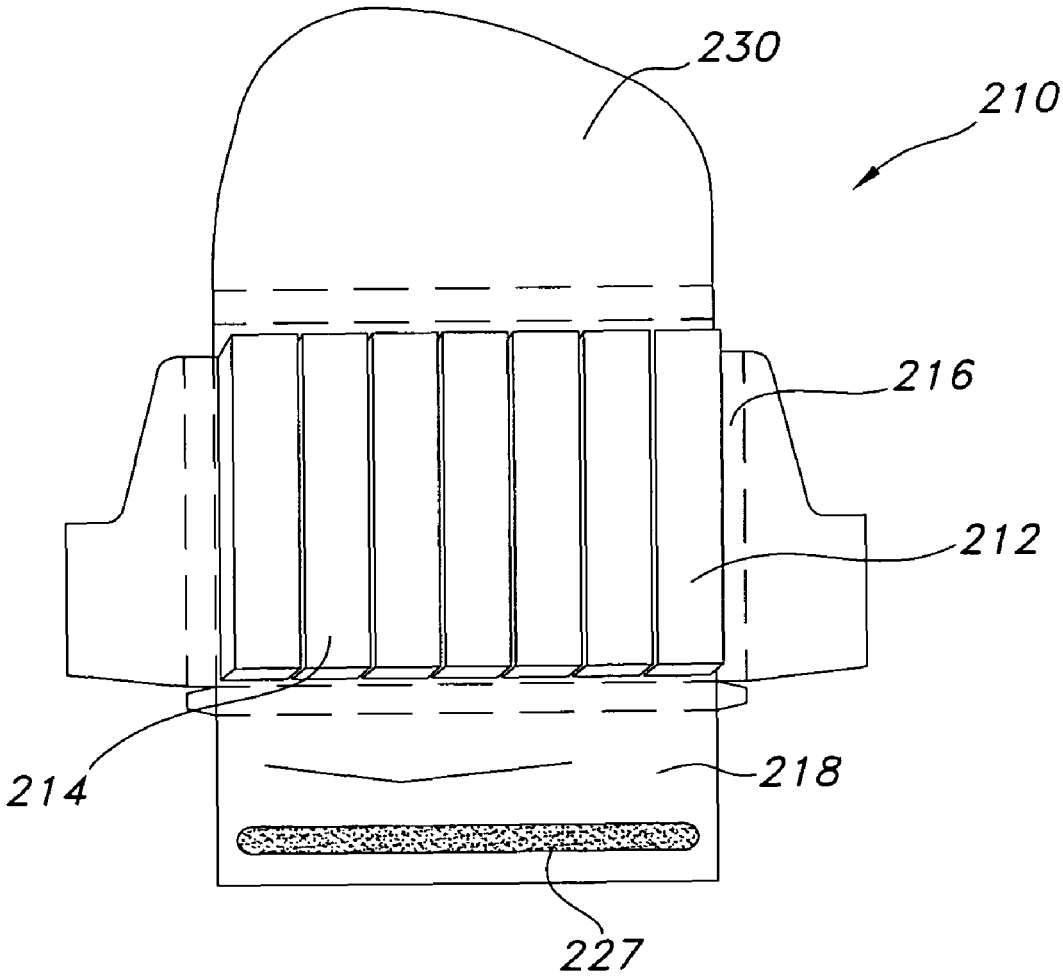
FIG. 5 shows another embodiment of the package housing of FIG. 1 in its preassembled condition with an array of products therein.

Referring now to FIG. 5, a further embodiment of the present invention is shown. With respect to the present embodiment, similar reference numerals denote similar elements with 200 added to the reference numerals of FIGS. 1 and 2 to denote the present embodiment.

FIG. 5 shows the package assembly 210 of package housing 216 in its preassembled condition. Package housing 216 is formed from a die cut paperboard which may be folded from its flat configuration shown in FIG. 5 into the configuration shown in FIGS. 1 and 2. The package housing 216 is shown to have the back wall 220, a foldable front wall 218, foldable side walls 224 and 226 and a foldable cover 230.

The package housing 216 supports an array 212 of gum slabs 214 against the interior surface of the back wall 220. In the present illustrative embodiment, the gum slabs may be either unwrapped or individually wrapped with wrappers. The gum slabs 214 are supported against the interior surface of back wall 220 without the benefit of any adhesive securement thereto. The front wall 218 includes an adhesive location in the form of a longitudinal adhesive strip 227 thereal-ong. When the preassembled housing is assembled into the configuration of FIG. 2 and the front wall 218 is folded, the adhesive strip 227 will make adhesive contact with the gum slabs transversely thereacross.

As the adhesive forming the adhesive location is releasable adhesive, it will allow for removable retentive engagement of the individual gum slabs from the package housing 216. Such releasable retention allows the gum slabs to be individually removed from the package while retaining gum slabs in place even after removal of an adjacent gum slab.

The embodiment of FIG. 5 employs a single adhesive location on the front wall 218 and achieves adhesive retention without the need of a band (FIG. 3) supporting the array 212 of gum slabs 214.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package assembly for individual elongate consumable products comprising:

a plurality of individual elongate consumable products arranged in a side-by-side array;

a package housing for enclosing said array of products, said package housing being formed from a flat blank having a back wall, a foldable front wall and an openable flap extending from said back wall for closing engagement with said foldable front wall to define a dispensing opening, said foldable front wall having an adhesive location applied therealong in engagement with said plurality of individual elongate consumable products for releaseably adhesively retaining said array of products in said package housing upon folding said front wall.

2. A package assembly of claim 1 wherein said adhesive location is a first longitudinal adhesive strip extending across said foldable front wall.

3. A package assembly of claim 2 wherein said first longitudinal adhesive strip is in engagement with said products.

4. A package assembly of claim 2 further including a band surrounding said array of products, said band holding said products in removable frictional retention.

5. A package assembly of claim 4 wherein said first longitudinal adhesive strip is in engagement with said band for adhesively supporting said band in said package housing.

6. A package assembly of claim 4 wherein said back wall of package housing includes a second adhesive strip therealong.

7. A package assembly of claim 6 wherein said second adhesive strip is engageable with said product array extending from said band for adhesively retaining said products therein.

8. A package assembly of claim 6 wherein said second adhesive strip is engageable with said band for supporting said band in said package housing.

9. A package assembly of claim 6 wherein said second adhesive strip is mutually engageable with said products extending from said band and with said band.

10. A package assembly of claim 4 wherein said band is in the form of a U-shaped pouch, said pouch supporting the end of said products of said array.

11. A package assembly of claim 4 wherein said band is formed from material including paper, foil and combinations thereof.

12. A package assembly of claim 1 wherein said adhesive location includes a releasable adhesive.

13. A package assembly of claim 12 wherein said releasable adhesive is wax.

14. A package assembly of claim 4 wherein said first longitudinal adhesive strip is mutually engageable with said band and said products extending from said band upon folding of said flap.

* * * * *